United States Patent [19]

Hendriks

[11] 4,251,616

[45] Feb. 17, 1981

[54] MAGNETIC TONERS AND DEVELOPMENT PROCESS

[75] Inventor: Dieter Hendriks, Geneva, Switzerland

[73] Assignee: Sublistatic Holding SA, Glaris, Switzerland

[21] Appl. No.: 809,495

[22] Filed: Jun. 23, 1977

[30] Foreign Application Priority Data

Jan. 7, 1976 [CH] Switzerland ..... 8430/76

[51] Int. Cl.[3] ..... G03G 13/09; G03G 9/14

[52] U.S. Cl. ..... 430/107; 430/106; 430/122; 430/903

[58] Field of Search ..... 427/21; 428/148; 430/107, 106, 122, 903

[56] References Cited

U.S. PATENT DOCUMENTS

| | | | |
|---|---|---|---|
| 2,846,333 | 8/1958 | Wilson | 252/62.1 |
| 3,320,169 | 5/1967 | East et al. | 252/62.1 |
| 3,639,245 | 1/1972 | Nelson | 252/62.1 |
| 3,838,054 | 9/1974 | Trachtenberg et al. | 252/62.1 |
| 3,925,219 | 12/1975 | Strong | 252/62.1 |
| 4,145,300 | 3/1979 | Hendriks | 427/18 |

FOREIGN PATENT DOCUMENTS

| | | | |
|---|---|---|---|
| 2606998 | 2/1976 | Fed. Rep. of Germany | 252/62.1 |
| 987767 | 3/1963 | United Kingdom | 96/1 R |

*Primary Examiner*—Edward C. Kimlin
*Assistant Examiner*—John L. Goodrow
*Attorney, Agent, or Firm*—Sprung, Felfe, Horn, Lynch & Kramer

[57] ABSTRACT

Dry developer for the development of electrophotographic latent images, consisting of a single type of very fine particle containing an electrically conductive substance, a magnetic substance and a binder, characterized in that it has a high conductivity, greater than $10^{-2}$ Siemens cm, and in that this conductivity is independent of the value of the electrical field applied and its use in a process for development of electrophotographic latent images wherein it is applied from an insulating surface.

10 Claims, No Drawings

MAGNETIC TONERS AND DEVELOPMENT PROCESS

The present invention relates to the electrographic development of latent images with a one-component developer or toner, in particular the development of latent images in the form of an electrical potential pattern, regardless of whether they are obtained by electrostatic charge as in conventional xerography, or whether they are obtained by some other equivalent device. The conditions are carefully controlled to form reproductions of excellent quality on a recording layer or carrier. The present invention relates also to new one-component toners.

The toners and the development process according to the present invention exhibit advantages over known processes and toners, by eliminating the disadvantages which were inherent in the two-component developers, in the liquid toners, in the development processes using low Van der Waals forces in the development of the image and by eliminating the other defective aspects of the known electrographic techniques for the development of latent images.

In particular, they represent an improvement relative to the process and to the toners described in U.S. Pat. Nos. 3,909,258 and 3,639,245.

Indeed, the toners of the present invention are magnetically attractable one-component development powders, that is to say, powders which consist of only one kind of particles). They have a high conductivity, greater than $10^{-4}$ Siemens/.cm and preferably greater than $10^{-2}$ Siemens/.cm, when the electrical field applied is 1 V/cm. Furthermore, they are ohmic toners, that is to say their conductivity is independent of the value of the electrical field applied. On the contrary, the toners described in U.S. Pat. No. 3,639,245 have a conductivity less than $10^{-4}$ Siemens/.cm if the field applied is 1 V/cm and this conductivity varies furthermore with the electrical field applied.

The toners of the present invention make it possible to employ a development process which is also one of the objects of the present invention. Said process does not call forth a well-defined differential electrical field between the photoconductive surface carrying the latent image and the surface exhibiting the development powder (or toner). This latter is not connected to earth or to any source of electrical potential, contrary to the process described in U.S. Pat. No. 3,909,258. Furthermore, contrary to this same patent, as well as to DOS No. 2 323 578, the surface bearing the toner is an insulating surface and not a conductive surface. The toners of the present invention can also be deposited selectively on an electrical potential carrying surface by means of other known devices for electrographic development with dry toners such as, for example, the known systems of magnetic brushes.

According to the invention, a new process of development is made possible by virtue of the new one-component magnetic toner described above. It consists of bringing into contact a recording surface having zones which are at an electrical potential different of that of the ground, (whereby these zones define a pattern corresponding to the model to be reproduced), with an insulating surface (that is to say an electrically non-conductive surface) carrying a magnetically attractable toner having a conductivity greater than $10^{-4}$ Siemens/cm and independent of the value of the electrical field applied. The toner is bonded to this surface by a magnetic attraction force. The contact is maintained for a sufficient duration to allow the toner particles to deposit selectively on the image zones to be developed. It is not necessary to set up a well-defined potential difference between the two surfaces (that is to say to connect the insulating surface to earth or to a source of electrical potential) in order to exert, on the toner particles, a temporary electrical transfer force greater than, and opposite to, the magnetic attraction force in the image zones and less than this magnetic attraction force in the background zones.

The technique used to produce an electrical potential pattern on a surface, said pattern defining the zones which will finally receive the toner (image zones) and the zones which will not receive the toner (background zones) can be any one of the techniques previously known. As an example the electrical potential pattern can be provided by imagewise charging electrostatically a dielectric layer overlying a conductive substrate, resulting from the imagewise projection of charged gas ions through an imagewise electrostatically charged screen. In this case, the original light image is projected on to a screen coated with a photoconductive layer and charged electrostatically. The final result, before development, consists of a dielectric layer imagewise charged, which provides a potential pattern suitable for the development process according to the invention.

Another example consists of a surface which provides an electronic conductivity pattern coincident with the electrical potential pattern, for example a layer comprising photoconductive zinc oxide disposed in an insulating binder, generally a binder of insulating resin. This layer can cover an electrically conductive substrate or may be an insulating layer between the photoconductive layer and the electrically conductive substrate. It should be noted that due to the sensitivity and the controllability of the process of the invention, the zinc oxide photoconductive layer can be present in markedly smaller amounts than in the earlier structures, namely less than 0.32 g/dm$^2$ of dry weight and generally less than 0.27 g/dm$^2$. This is advantageous from a cost and aesthetic standpoint because, in such a case, a sized paper coated with zinc oxide more closely approximates the fiel of conventional sized paper. Other surfaces of this type consist of a layer of selenium or of photoconductive cadmium sulphide or titanium dioxide dispersed in an insulating resinous binder which layer covers an electrically conductive substrate.

An appropriate technique for producting the electrical potential pattern, utilising surfaces of this type, is the application of an uniform electrostatic charge and then the exposure of the surface to a light pattern. The surfaces of this type comprise image zones which are relatively electrically insulating and background zones which are relatively electrically conductive.

As an example of a device which makes it possible to deposit selectively the toner of the present invention on the electrical potential pattern, a device known by the name of "magnetic brush" may be mentioned.

This device consists of a development drum comprising a cylindrical magnetically permeable shaft on which are mounted several cylindrical sector-shaped magnets. The number of magnet sectors is such that the toner is transported uniformally around the shell of the development drum. These sectors consist of a permanent magnet. The magnets are magnetised uniformally along their length. The cylindrical shell of the development drum is not electrically conductive, and consists of (or is coated with), for example, a polymer which does not charge the particles electrically, or of anodised aluminium. It is coaxial to the shaft and to the magnet sectors and is surrounding these sectors. Contrary to the known devices, it does not comprise any device which connects it to an electric current potential or to earth.

A highly electronically conductive toner capable of magnetic attraction, is placed in a reservoir adjacent to the surface of the envelope. As the shell rotates, the toner is dispersed regularly and uniformly at its surface and adheres thereto by the magnetic forces induced by the magnetic sectors. The amount of toner on the shell can be regulated by varying the distance between the reservoir edge and the surface of the shell. Instead of rotating the shell, the shaft and the magnet sectors fixed thereto can be rotated whilst keeping the shell stationary. Both techniques can be used in the invention and and work equally well, permitting the regular, uniform and well-controlled dispensing of the toner from the reservoir.

In operation, the development drum is placed above the layer of the recording element carrying the pattern of potential, so that the axis of the development drum is parallel to the plane of this layer. The development drum is placed at such a distance from the layer carrying the pattern of potential, that the uniform toner layer dispersed on the shell comes into contact with this layer, forming a well-defined nip region. The relative movement of the development drum and of the layer carrying the pattern of potential is effected whilst maintaining a uniform distance between the shell and this layer.

Due to the presence of the magnetic field in the nip region formed between the development drum and the potential pattern bearing layer, the magnetic toner is converted into small chain-like groups, similar to the hairs of a brush, which follow the lines of magnetic force between the insulating shell and this layer.

Preferably, the shaft and the magnetic sectors are driven at a speed of rotation greater than 400 revolutions/minute, to ensure satisfactory transport of toner in order to obtain good reproduction of the solid zones. In this way, images with high contrast are developed which exhibit low background coloration and in which the solid zones are filled. The developed image can be fixed directly onto the recording element or may be transferred by conventional means onto another substrate. The devices for doing this are well known to those skilled in the art.

In this process, since the shell of the development drum is not connected to any potential, nor to earth, it is not necessary to maintain the contact between the development device and the potential pattern carrying layer for a sufficiently long time to render the fields induced from this shell able to reach to particles of toner adjacent to said potential pattern bearing layer. The transfer of the toner is virtually instantaneous.

The toners of the present invention are in the form of a powder containing a single type of particle which is highly conductive and of which the specific resistivity is less than $10^4$ Ω.cm, preferably less than $10^2$ Ω.cm and is virtually independent of the value of the electrical field applied. The particles of toner preferably contain a conductive substance such as, for example, carbon, which is either uniformly distributed in the particles or is only distributed in a zone near their surface.

The particles are magnetic particles which are capable, for example, of being held on a development device of the "magnetic brush" type with a sufficient magnetic force to counterbalance the forces of attraction exerted from the non-image zones of the layer which carries the potential pattern. They can contain up to 85% of a preferably ferromagnetic substance, such as, for example, $Fe_2O_3$.

They must contain from 2 to 20% of electroconductive substance such as, for example, carbon black or a metal powder, in order to behave the required conductivity. That percentage varies with the involved electroconductive substance and also with its distribution method. If the electroconductive substance is distributed only at the surface of the toner particles, for a given value of the conductivity, said percentage may be lower than if it is distributed uniformly in the particles. An amount of 2% can be sufficient for the first mode of distribution, whereas the amount of electroconductor must be of at least 5% when it is uniformly distributed into the particles. Said toner particles contain also a polymer in an amount which can vary from 10 to 50%, preferably a thermoplastic polymer or copolymer which can contain a wax or plasticizer. They are essentially spherelike-shaped particles, the mean size of which is of the order of 2 to 40μ, preferably of the order of 5 to 25μ.

In a particular embodiment of the present invention, the toner contains 15% of carbon and 20% of a polymer based on about 81% of styrene and 19% of butadiene, the remainder (65%) being magnetite ($Fe_2O_3$). However, the percentage of the different constituents can vary and other conductive substances, other ferromagnetic substances and other binders can be used according to the invention.

The polymer which can constitute the binder can be chosen from amongst polymers of very diverse categories. They can be thermoplastic polymers softening between 100° and 160° C. If they are capable of forming a film and are dispersible in water, they are of particular interest. Products which form a film below 100° C., preferably at between 40° and 80° C. can be advantageously used. It is also possible to use mixtures of water-dispersible polymers and polymers which are soluble in an organic medium, or mixtures of thermoplastic resins with other types of resins, for example with brittle resins such as modified phenol-formaldehyde resins or modified maleic anhydride/polyhydric alcohol resins or esterified diphenol resins, or copolymers. The latter can be block or graft copolymers and can optionally consist of a mixture of crystalline and amorphous segments.

They can be chosen from amongst the polysaccharide ethers and esters, such as cellulose esters, particularly cellulose acetate or acetobutyrate, and especially such as cellulose ethers, for example benzylcellulose, hydroxyethylcellulose, hydroxybutylcellulose, hydroxypropylcellulose, 2,3-dihydroxypropylcellulose or particularly ethylcellulose.

Materials to be mentioned are the polyesters, polyamides, polyolefines, epoxy resins, vinyl resins, acrylic resins, polystyrenes, the copolymers of styrene or styrene homologue with alkylmethacrylates or alkylacrylates, the phenol-formaldehyd resins, optionally modified by colophonium, the epoxy resins, the polyethylenes, the polyvinylchlorids, the alkyl resins modified by colophonium and mixtures thereof such as the mixture of polystyrene with polybutadiene, of acrylic polymers with polyvinylacetate, of polyurethanes with vinyl polymers as well as mixtures of polyamides with polyolefines.

Amongs the polyamides as well aromatic polyamides as polyamides prepared from polymerised fatty acids and alkylenediamine, polyalcohols and hydroxyamides can be used.

The following copolymers can also be cited as an example of suitable compounds: a copolymer of a glycidyl monomer (for example glycidyl acrylate or methacrylate) with an ethylenically unsaturated monomer, or of polybutadienes with a vinyl monomer, or of fatty unsaturated acid esters with maleic anhydride mixed with an oily polybutadiene or of an unsaturated ester of low molecular weight with one or several ethylenically unsaturated monomers.

The following terpolymers can also be cited as examples: the vinyl acid/hydroxyalkyl acrylate or methacrylate/vinyl monomer or acrylic acid/vinylidene chloride/acrylonitrile terpolymers, or the copolymers of a vinyl ester, ethylene and an acrylamide, or the olefine/acrylate copolymers, or the copolymers of styrene and indene with acrylonitrile.

Further materials to be mentioned are the copolymers of N-vinylcarbazole with a trialcoxyvinylsilane or a triacetoxyvinylsilane, optionally containing units of styrene or of an alkyl acrylate or alkyl methacrylate, the copolymers obtained by grafting at least one ethylenically unsaturated monomer onto an alkyl resin or obtained by reacting a phenol or an ethylenically unsaturated compound with a polydiolefine (such as polydicyclopentadiene, polybutadiene or other homopolymers of $C_4$–$C_{10}$ dienes), or with a copolymer of butadiene or of a cycloaliphatic diene and isoprene or butadiene; the reaction products of a higher fatty monoacid with a prepolymer of cyclopentadiene, of dicyclopentadiene substituted by an alkyl, an unsaturated alcohol or an ester of an unsaturated alcohol and an organic acid; the reaction products of one or more epoxide resins, which are optionally partially etherified with fatty acids, with one or more compounds obtained from dienes and unsaturated carboxylic or dicarboxylic acids or anhydrides; the intimate mixtures of polyvinyl acetate and a compatible epoxy resin or an acrylic polymer with cellulose acetobutyrate.

The resin plasticiser or resin-wax mixture can contain up to 85% by weight of wax or up to 30% of plasticiser. The plasticiser is preferably soluble in the organic solvents.

Amongst the plasticisers which can be used in accordance with the present invention, there may in particular be mentioned esters of phosphoric acid such as tributyl phosphate, methyl diphenyl phosphate, cresyl diphenyl phosphate, tri-(2-ethylhexyl) phosphate, triethyl phosphate or triphenyl phosphate, esters of phthalic acid, and various esters such as abietates, adipates, butyrates, hexanoates, glycolates or stearates, for example diisooctyl adipate, methyl abietate, butyl stearate, triethylene glycol di-(2-ethylbutyrate) or triethylene glycol di-(2-ethylhexanoate). There may also be mentioned amides, such as p-toluenesulphonamide, mineral oils, fatty acids, such as linseed oil, fatty alcohols, such as myristyl alcohol or stearyl alcohol, vegetable oils or plasticisers of various kinds such as camphor, benzene hexachloride, phenol, phenylcellosolve and the like. The developers can contain between 0.5 and 30% of plasticiser, preferably at between 5 and 20%.

The waxes which can be used in accordance with the present invention can be either of mineral origin or of vegetable or animal origin and can be in the crude state or refined. They can also be synthetic. They can be esters of high molecular weight fatty acids and high molecular weight alcohols, or long-chain paraffins and their derivatives (alcohol, halogenated derivatives, ketones, acids, ethers, or esters of cyclic or aliphatic alcohols) obtained by FISCHER-TROPSCH synthesis, derivatives of polyethylenes or of polyolefines which have been polymerised using ZIEGLER-NATTA catalysts. It is also possible to use mixtures, which optionally contain metal salts, silicone oils, polyethylene or polyisobutylene.

Examples which may be mentioned are beeswax, ozokerite, myrtle wax, Japan wax, China wax, sugar cane wax, palm wax, carnauba wax, candellila wax, caranda wax, hydrogenated castor oil, certain mineral bitumens, such as the esters of the acid $C_{27}H_{55}COOH$ with ceryl or myricyl alcohol (MONTAN WAX), mixtures of cetyl alcohol with octadecyl alcohol or stearyl alcohol (LANETTE WACHS), mixtures containing the palmitate of myricyl alcohol ($C_{15}H_{31}COO—C_{30}H_{61}$), cerotic acid ($C_{25}H_{51}$-COOH) or melissic acid ($C_{29}H_{59}COOH$), the myricyl ester, cerotic acid, or ceryl alcohol, for example.

The magnetic particles contained in the developer particles of the present invention consist of a ferromagnetic material, for example $Fe_2O_3$ which has been cited above or another magnetic iron oxide such as $Fe_3O_4$, or iron, or magnetic oxides of metals such as cobalt, nickel and manganese, or magnetic alloys of these metals together or with iron, for example. Barium ferrite or nickel-zinc, or chromium oxide and nickel oxide, and the like, may be mentioned as example.

The developer of the present invention can contain a black pigment for example, or a dyestuff or dyestuffs mixture, especially sublimable or vaporisable dyestuffs, preferably between 130° and 240° C., which permit to obtain colored reproductions by dry heat transfert.

They can further contain other adjuvants, such as agents modifying the surface properties of the developer particles, for example antistatic or hydrophobic agents, non-stick agents, and also agents improving the flowability of the developer powder or maintaining its rheological behaviours or agents such as emulsifiers or anti-foaming agents which facilitate the manufacture of the developers.

The developers (or toners) of the present invention are prepared by known methods, such as, for example, thermodiffusion, selective coating, fluidised bed coating or spray-drying technique.

It is for example possible to proceed by melting the polymer or the thermoplastic mixture used as binder, then by kneading it with the dyestuff or dyestuffs mixture, the magnetic grains and the electroconductive powder and by grinding that mixture after cooling. The particles part which have a given size for example these which have approximately a diameter in a given range, are separated. The powder is then "spheroidized".

It is also possible to add the electro-conductor only after the spheroidization step instead of adding it before the grinding. The spherelike shaped particles are then heated to a temperature which can at least soften or melt the binder in order to permit the conductive grains to become essentially completely embedded in the binder, at the surface of the toner particles.

In another especially suitable known preparation method, a cloud of droplets is dried in an appropriate stream of air. These droplets have been obtained from a suspension or a dispersion of the binder, the electroconductive powder and the magnetic grains. It is possible to use an as well an aqueous than an organic medium. For example, the magnetic particles can be mixed with the other components of the developer before the drying, for example by grinding with a dispersing agent and water. The paste thus obtained is generally viscous. It is added by stirring to an aqueous dispersion or suspension which contains the other components.

The ultimate suspension or dispersion intended to be sprayed into droplets and then dried in an appropriate stream of air, contains generally from 30 to 60% of solid product and has generally a Cup Ford no. 4 viscosity of 10 to 22 seconds.

The temperature at which the drying is carried out is normally between 150° and 200° C. at the inlet of the apparatus and between 60° and 100° C. at the outlet.

This temperature is determined by the softening point of the binder and by the minimum temperature at which a film begins to form from a dispersion of the binder. The dyestuff can be added before or after the binder has been mixed with the magnetic grains.

The thus obtained powder can be submitted to a particle screening operation, for example by centrifuging. In this way, the particles having for example a diameter between 10 and 35$\mu$ are isolated.

The powder can also be subjected to a treatment with silicon oxyde, preferably in a finely divided form.

The pulverulent resin compositions of the invention are preferably used in electrophotography, as developers, but they can also be incorporated into coating compositions, paints, inks and the like.

The non-limiting examples which follow illustrate the present invention. In these examples, the parts and percentages are to be understood as being by weight, unless stated otherwise, and the temperatures as being in degrees Centigrade.

EXAMPLE 1

65 parts of iron oxide $Fe_2O_3$ can be dispersed in 30 parts water with 1,3 parts of sodium sulphate of a condensation product of a naphthalene derivative with formaldehyde. A paste is obtained, to which are added 60 parts of a 25% strength dispersion of active charcoal in water and 40 parts of an aqueous dispersion containing 12.5% of polystyrene and 37.9% of a copolymer of styrene and of butadiene. Finally, 3.7 parts of water are added, after which this dispersion is sprayed and dried in a spray-dryer, that is to say in a device providing a spray of fine droplets from the dispersion and drying these droplets in a stream of air. The temperature is of about 150° C. at the inlet of the apparatus at only of 80° C. at the outlet.

A black powder is thus obtained, with spherelike shaped, free flowing particles with an particle diameter ranging from 10 to 35$\mu$. Their conductivity is greater than $10^{-2}$ Siemens/cm.

When 5 parts of 1-amino-2-phenoxy-4-hydroxy-anthraquinone are added to the aqueous paste containing $Fe_2O_3$; and by proceeding as indicated further above, a black powder is also obtained, with the same properties as above. But they permit additionally to obtain a final copy colored in red, of great quality, by subliming on a receiving carrier the dyestuff which is contained in the image developed with the conductive toner.

When the red dyestuff indicated above is replaced by 3'-hydroxy-quinophthalone or by 1-amino-5,8-dihydroxy-4-isopropylamino-anthraquinone, a final copy colored respectively in yellow or blue is obtained.

As good results are obtained when the aqueous dispersion which contains the mixture of polystyrene and butadienesyrene copolymer is replaced by 40 parts of an aqueous dispersion containing 50% of a polyester, a polyamide, a epoxy resin, polyvinylidene chloride or of a styrene-polyacryl copolymer or polyacryl-polyvinyl acetate copolymer or of a natural wax with a softening temperature of 75° C. or even of a mixture containing 79% polystyrene, 16% ethylcellulose and 5% dibutylphtalate. The thus obtained black powders are also free flowing, highly conductive, with spherelike particles having a diameter ranging between a minimum of 2 to 5$\mu$ and a maximum of 40 to 45$\mu$.

EXAMPLE 2

20 parts of polystyrene are melted and ground with 65 parts of $Fe_2O_3$ and 15 parts of active charcoal, to give an homogeneous mixture. The mixture is then allowed to cool and ground and the particles having a size of between 2 and 35$\mu$ are separated off. On treating these with hot air in a fluidised bed, spherical particles are obtained.

The thus obtained black powder gives results which are as good as these obtained with the toner powder of example 1.

When only the iron oxide and the melted polystyrene are mixed and when, after having spheroidized the particles and heated them to temperature which can at least soften the polystyrene, 4 parts of charcoal are added. A black powder is obtained which gives as good results as the powder prepared accordingly to the above other examplified methods.

I claim:

1. Dry developer for the development of electrophotographic latent images, consisting of a single type of very fine particle containing from 5 to 20 percent of an electrically conductive substance, a magnetic substance one or more dyestuffs which are sublimable or vaporisable between 130° and 240° C. and a binder, characterised in that it has a high conductivity, greater than $10^{-2}$ Siemens/cm, and in that this conductivity is independent of the value of the electrical field applied.

2. Developer according to claim 1, characterised in that it consits of spherical particles.

3. Developer according to claim 1, characterised in that it consists of particles of which the mean size is between 2 and 40$\mu$.

4. Developer according to claim 1, characterised in that it consists of particles of which the mean size is between 5 and 25$\mu$.

5. Developer according to claim 1, characterised in that it contains a wax, especially an ester of the acid $C_{27}H_{55}COOH$.

6. Developer according to claim 1, characterised in that it contains a polymeric binder, especially polyvinyl chloride, polystyrene or copolymer of styrene with butadiene or with an acrylic monomer.

7. Developer according to claim 1, characterised in that the binder contains a plasticiser.

8. Developer according to claim 1, wherein the electrically conductive substance is carbon.

9. Process for the development of electrophotographic latent images with a dry developer containing from 5 to 20 percent of electrically conductive substance, characterised in that an insulating surface carrying the developer is brought into contact with the recording layer carrying an electrical potential pattern, the insulating surface being neither connected to any electrical potential, nor to earth, and the developer consisting of a binder and one or more dyestuffs which are sublimable or vaporisable between 130° and 240° C. being a magnetic highly conductive developer with a conductivity greater than $10^{-2}$ Siemens/cm, and in that this contact is maintained for a sufficient duration to allow the developer particles to deposit selectively on the zones of image to be developed.

10. Process according to claim 9, characterised in that the insulating surface carrying the developer is the shell of a drum of the type used in the so-called "magnetic brush" development processes.

* * * * *

UNITED STATES PATENT AND TRADEMARK OFFICE

CERTIFICATE OF CORRECTION

PATENT NO. : 4,251,616

DATED : Feb. 17, 1981

INVENTOR(S) : Dieter Hendriks

It is certified that error appears in the above-identified patent and that said Letters Patent are hereby corrected as shown below:

Title Pg. Priority Delete "Jan. 7," and insert --July 1,--.

Signed and Sealed this

*Fifteenth* Day of *September 1981*

[SEAL]

*Attest:*

GERALD J. MOSSINGHOFF

*Attesting Officer* *Commissioner of Patents and Trademarks*